US006036032A

United States Patent [19]

Moscatelli

[11] Patent Number: 6,036,032

[45] Date of Patent: Mar. 14, 2000

[54] FIREWOOD LOG STORAGE RACK

[76] Inventor: Edward Dominic Moscatelli, 3854 Sutherland Dr., Park City, Ill. 60085

[21] Appl. No.: 09/289,283

[22] Filed: Apr. 9, 1999

[51] Int. Cl.[7] ..... A47F 1/04

[52] U.S. Cl. ..... 211/60.1

[58] Field of Search ..... 211/60.1, 49.1, 211/189

[56] References Cited

U.S. PATENT DOCUMENTS

| | | | |
|---|---|---|---|
| 732,037 | 6/1903 | Best | 211/60.1 |
| 3,559,812 | 2/1971 | Wolf | 211/60.1 |
| 4,333,574 | 6/1982 | Christy, Sr. | 211/60.1 |
| 4,616,757 | 10/1986 | Hobson | 211/60.1 |
| 4,971,207 | 11/1990 | Baucom | 211/60.1 |
| 5,385,247 | 1/1995 | Owens | 211/60.1 |
| 5,743,413 | 4/1998 | Noll | 211/60.1 |
| 5,941,398 | 8/1999 | Harris | 211/60.1 |

*Primary Examiner*—Alvin Chin-Shue
*Assistant Examiner*—Sarah Purol

[57] ABSTRACT

My invention relates to a novel configuration of a firewood log, lumber and kindling storage rack that also embodies an accurate measuring device for stacking and storing firewood materials and to inform both firewood material vendors and consumers as to what constitutes a truthful standard bulk quantity purchase transaction that presently is loosely understood by many firewood material vendors who may be unaware of existing standards and knowingly or inadvertently short the consumer an accurate delivery knowing that the consumer has to take the vendor's word for an accurate delivery, and many consumers have no way of verification of delivery accuracy. My invention offers both the vendor and consumer physical proof of an honest transaction and the vendor can insure consumer confidence by having a storage rack stacked with firewood materials and displaying information indicating quantity displayed and attendant cost. The consumer can also check and verify honest delivery when the delivered firewood material is stacked into the consumers' storage rack. If the consumer does not have a storage rack, the consumer is forced to trust the vendor. Further, the storage rack eliminates common delivery practice of dumping the firewood material in an unsightly random pile, that if left on the ground, will absorb and retain moisture, mildew, wet wood and wood rot that causes difficulties in starting a fire. My invention provides a means of keeping the firewood materials above ground allowing air to circulate about the firewood materials and to promote drying out of newly cut firewood materials.

10 Claims, 6 Drawing Sheets

FIREWOOD LOG STORAGE RACK

This invention relates to a novel concept and configuration of storage of firewood logs, lumber, and kindling.

BACKGROUND OF THE INVENTION

Objects and Advantages

The principal objective of the invention is to provide a storage rack to stack and store firewood logs, lumber, and kindling in an orderly neat manner.

A further object of the novel configuration of the storage rack is to keep logs, lumber, and kindling above ground to retard moisture, mildew, wet wood and wood rot by allowing air to freely circulate about the firewood logs, lumber, and kindling, and to facilitate drying out of recently cut firewood materials.

In addition, common delivery practice of firewood logs is to simply dump them onto the ground in a random unsightly pile where the firewood, if left on the ground for any length of time, would be subject to ground moisture, mildew, wet wood and wood rot, all of which contributes extreme difficulty when starting a fire. Another object of the invention configuration assures the firewood log vendor that he is protecting himself by selling an exact measured bulk quantity of firewood logs and that the purchaser can expect the same upon delivery.

The confusion of what constitutes an accurate bulk measure of firewood logs or lumber is further exacerbated by the fact that many firewood vendors and their employees are not sure or aware of the specific technical standard in dimensions in cubic feet of a volume of a standard cord, that when densely stacked into a rectangular configuration is defined as 8 feet long, by 4 feet high, and 4 feet deep, and occupies a volume of 128 cubic feet.

A ⅓ cord, also known as face cord or rick, has dimensions of 8 feet long, by 4 feet high, and anywhere from 1 to 3 feet deep, and occupies a volume of 32 to 96 cubic feet.

A ¼ cord has dimensions of 6 feet long, by 3 feet high, and 1 to 3 feet deep, and occupies a volume of 18 to 54 cubic feet.

Other than sales of small bundles of firewood logs that will be sufficient for 1 or 2 fireplace fires, the most popular larger firewood log purchases are either the ⅓ cord, or the ¼ cord.

My research indicates that most fireplace manufacturers and housing construction installers build fireplaces to accommodate a maximum popular log length of about 2 feet.

It must be emphasized that because firewood logs and lumber vary in diameter and cross-section, it is the bulk or volume in cubic feet that sales and delivery are based on and not the number of individual pieces or weight of logs or lumber.

Therefore, the first embodiment of my invention holds ⅓ cord, also known as face cord or rick, and will, by its configuration, accept the bulk logs and lumber that will fill an enclosed dedicated opening which is 8 feet long, by 4 feet high, and 2 feet deep or 64 cubic feet, and the second embodiment of my invention which holds ¼ cord, provides a dedicated opening of 6 feet long, by 3 feet high, and 2 feet deep and will accept bulk logs occupying 36 cubic feet.

It is apparent that a standard measuring device is desirable to assure an industry acceptable measuring agreement by both vendors and purchasers.

The need for a measuring device with stacking and storage capacity were the germ of the idea, seed, and motivation to conceive my invention concept and reduce it to practice. The first and second embodiments of my invention are solutions to the stated problem.

The first and second embodiment of my invention comprises an enclosed dedicated opening that when fully stacked with firewood materials encompasses an accurately defined measure of bulk quantity of firewood wherein the enclosed boundaries are defined as the bottom surface of the kindling wood trough, the lateral space between the upright end posts, and the top surface of the base support.

Another object of the first embodiment of my invention is to provide above ground storage of firewood to be sufficiently above ground to retard moisture, mildew, wet wood and wood rot which causes difficulties in starting a fire.

An additional object of the first embodiment of the invention is to provide a U-shaped cross-sectional trough to contain loose kindling wood and also to act as a bridge type member mounted between the opposite positioned upright posts of the storage rack to assure a rigid rack framework.

The U-shaped trough provides for above ground storage of kindling wood commonly characterized as small irregular disparate shapes of unequal lengths normally used to hasten the initial combustion process prior to adding heavier firewood that will ignite and burn quickly from the immediately produced intensified heat of the fast burning kindling as a result of increased oxygen and created updraft.

The second embodiment of my invention is similar to the first embodiment relating to the provision for above ground storage of firewood to be sufficiently above ground to retard moisture, mildew, wet wood and wood rot which cause difficulties in starting a fire.

An additional object of the second embodiment of the invention is also similar to the first embodiment and relates to a V-shaped cross-sectional trough to contain kindling wood and also to act as a bridge type member mounted between the opposite positioned upright posts of the storage rack to assure a rigid rack framework.

The V-shaped trough provides for above ground storage of kindling wood commonly characterized as irregular disparate scraps of unequal lengths normally used to hasten the initial combustion process prior to adding heavier firewood that will ignite and burn quickly from the immediately produced intensified heat of the fast burning kindling as a result of increased oxygen and created updraft.

Another feature of the V-trough of the second embodiment of my invention provides the additional function of restraining long tree saplings, or long pieces of lumber with taut bungee cords for safety purposes preparatory to being sawed into logs. The tree saplings, or lumber, can be extended laterally beyond the rack in a cantilevered position whereby tree saplings or lumber can be sawed into predetermined log lengths as shown in FIG. 6B.

An extension of the versatile applications of the invention can be useful by the firewood log vendors or any store or lumberyard to present a neat point of purchase display of their logs in a pleasing and appropriate manner that will attract purchasers. The vendor can indicate on a display that the first embodiment holds an exact ⅓ cord or face cord, when fully stacked, and that the second embodiment holds an exact ¼ cord, when fully stacked, to assure the purchaser of an honest delivery. The bulk logs or lumber is contained within the openings as shown in the first embodiment, FIG. 1A, that holds a full ⅓ cord, also known as face cord, and the second embodiment, FIG. 1B, that holds ¼ cord. These are the two most commonly purchased quantities when purchases larger than small bundles of logs is desired.

The invention will lend itself to diverse uses, some of which are storing garbage cans, lawn care products and equipment, hardware, plant potting materials, potted plants, and lumber.

This invention is not limited to being constructed out of wood, but members can be constructed out of other materials of varied cross-sections or may be selected from a group consisting of metal alloys, steel, aluminum and plastic, all of which will maintain the same basic configuration and remain faithful to the integrity and original intent of the invention concept.

SUMMARY OF THE INVENTION

An object of the first and second embodiments of my invention is to provide a storage rack to store firewood logs, lumber and kindling wood in a neat orderly manner and provision to store an accurate bulk quantity of firewood to comply with industry standards for various bulk quantity purchases that are common.

The first embodiment of my invention ⅓ cord, also known as face cord or rick and the second embodiment of my invention ¼ cord offers a standard measuring device to assure the firewood vendor and consumer an acceptable solution to verification of an honest transaction.

Further, the storage rack configuration of both first and second embodiments of my invention allows for provision of firewood to be sufficiently above ground to retard moisture, mildew, wet wood, and wood rot as opposed to firewood being left on the ground in an unsightly pile that will be subjected to ground moisture, mildew, wet wood and wood rot that will cause difficulties when starting a fire.

An additional feature of the second embodiment provides for restraining long saplings or long pieces of lumber preparatory to and finally being sawed into predetermined log lengths.

DESCRIPTION OF THE SEVERAL VIEWS OF THE DRAWINGS

The above and other features, objects and advantages of the first embodiment of my invention will be fully understood from the following description in connection with the accompanying illustrative drawings in which.

Figure 1A:
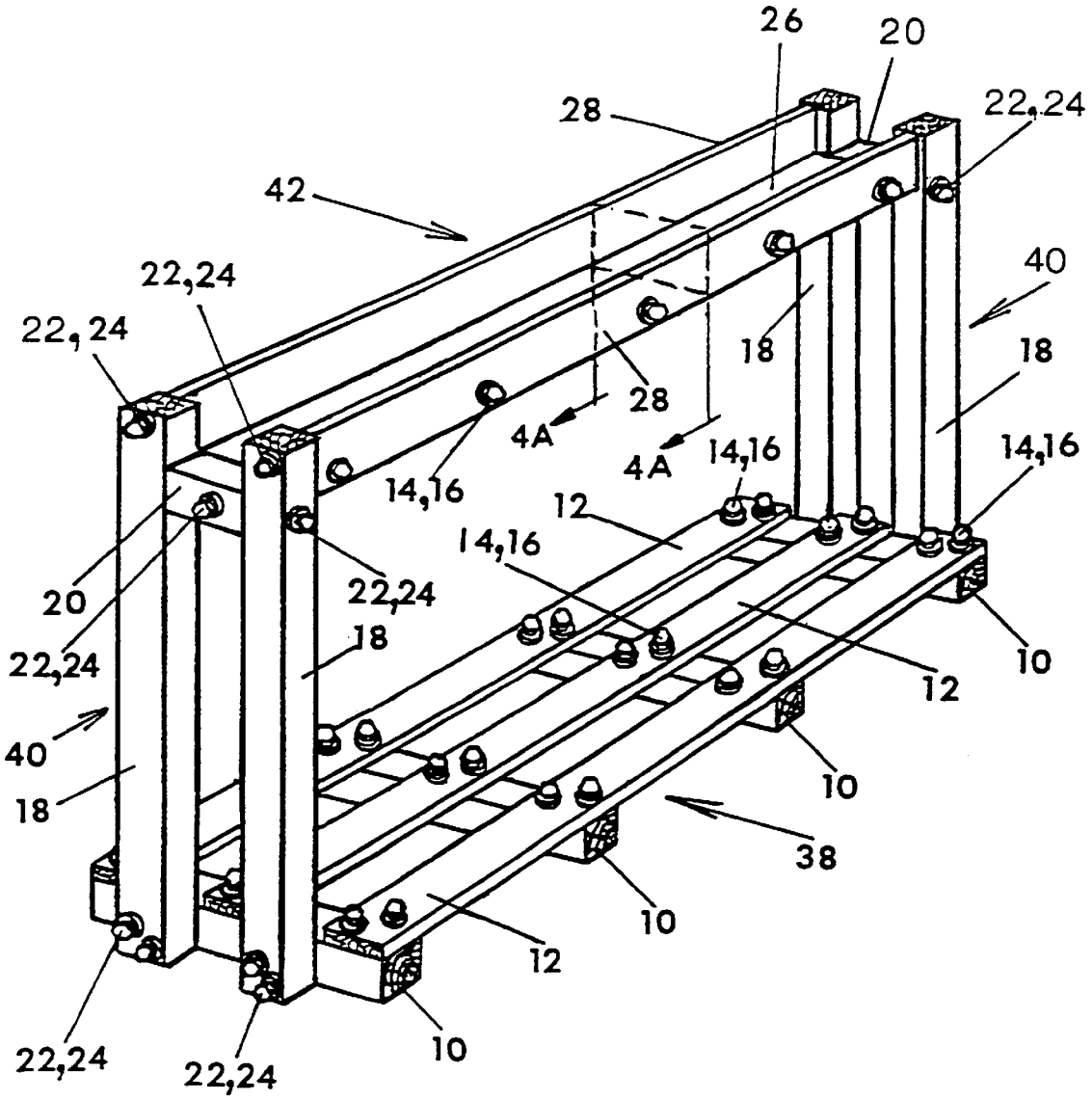
FIG. 1A is a perspective view of the first embodiment of the firewood log storage rack.
Figure 1B:
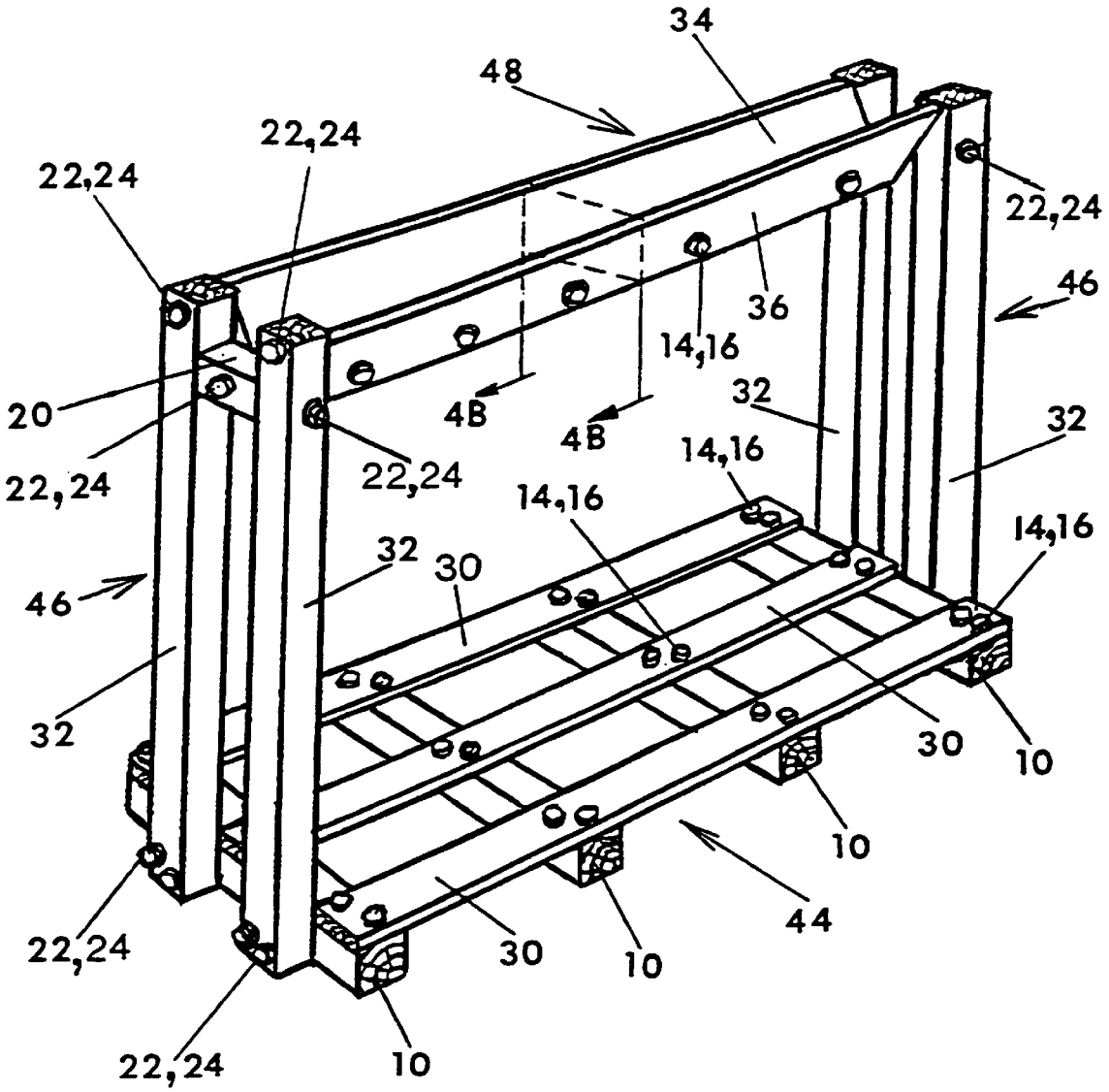
Figure 2A:
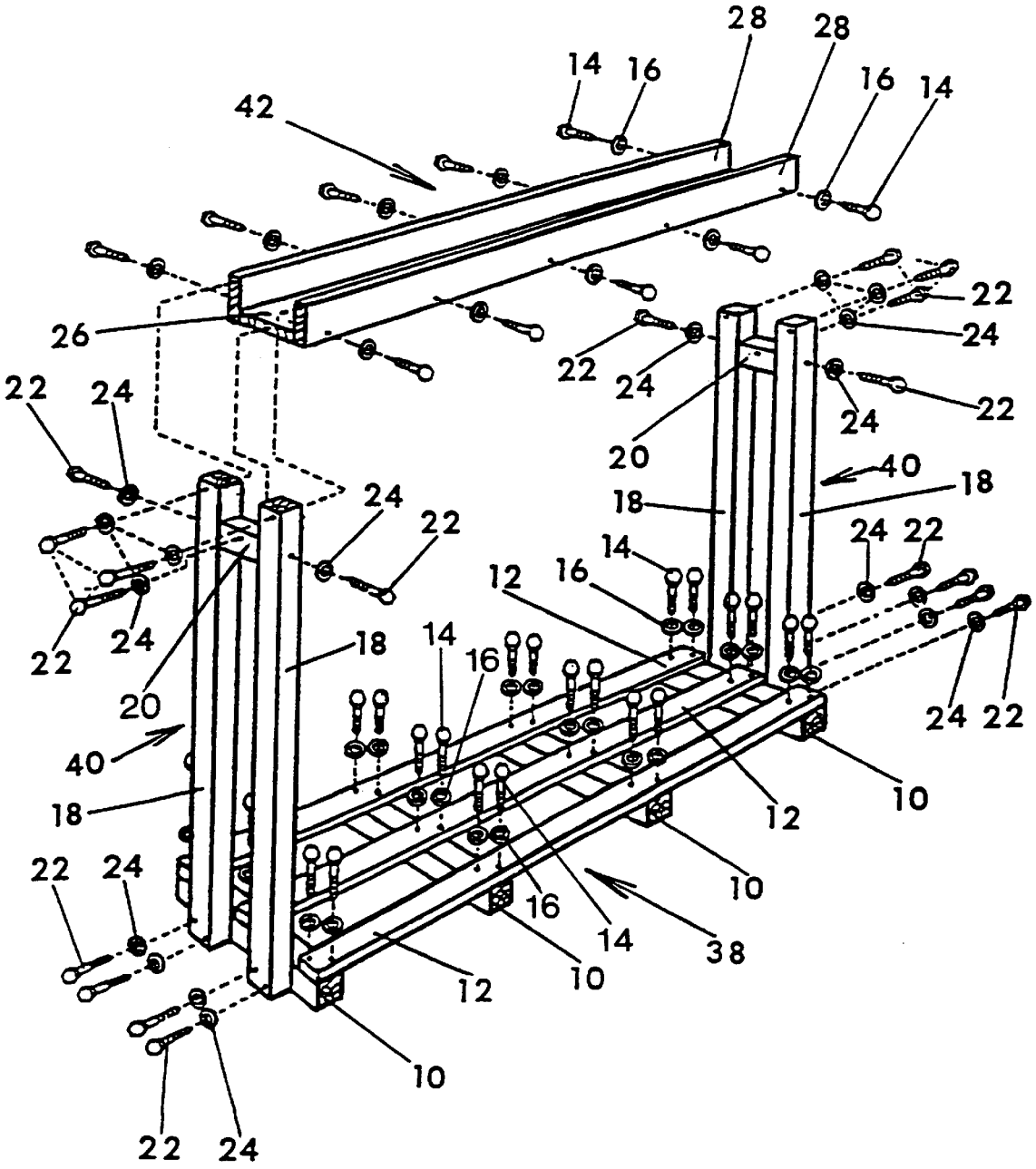
FIG. 2A is a perspective exploded view of rack, thereof.
Figure 2B:
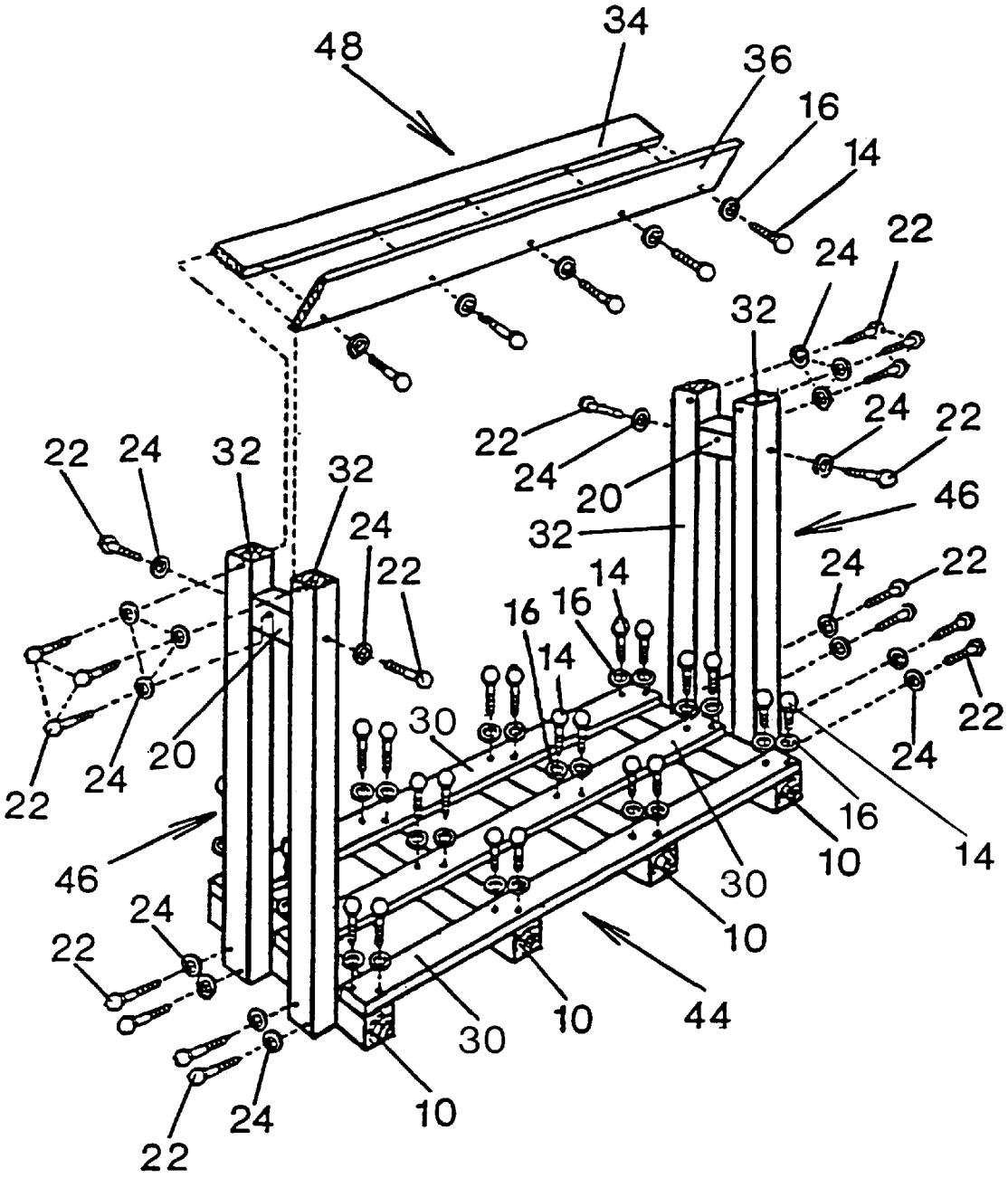
Figure 3A:
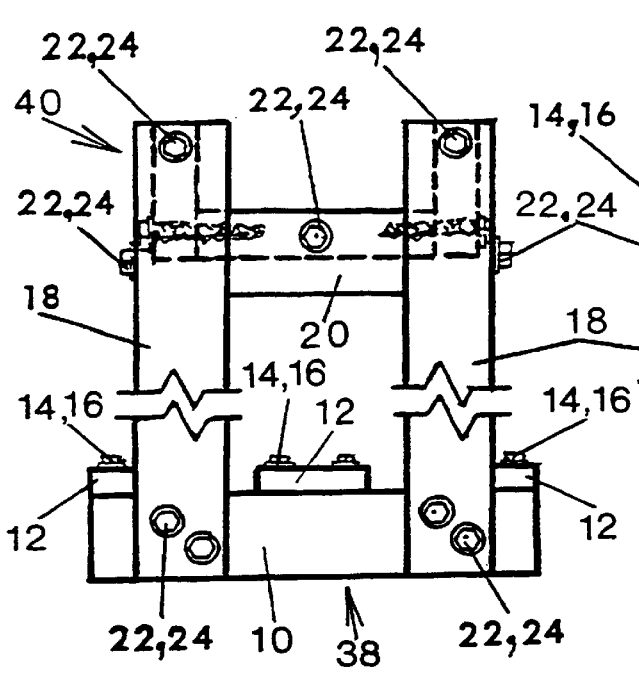
FIG. 3A is an enlarged rear elevation view of both external ends of rack.
Figure 4A:
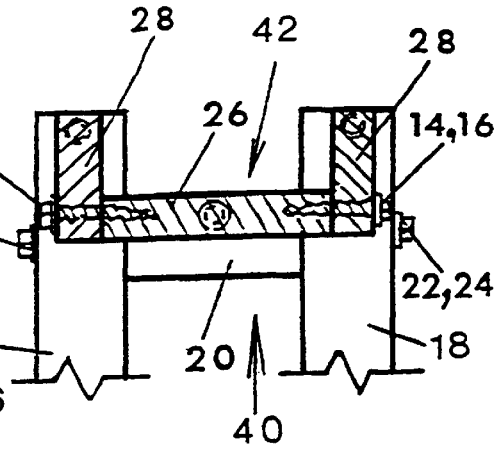
FIG. 4A is an enlarged partial cross-sectional view of FIG. 1A taken along the plane 4A—4A of FIG. 1A.
Figure 5A:
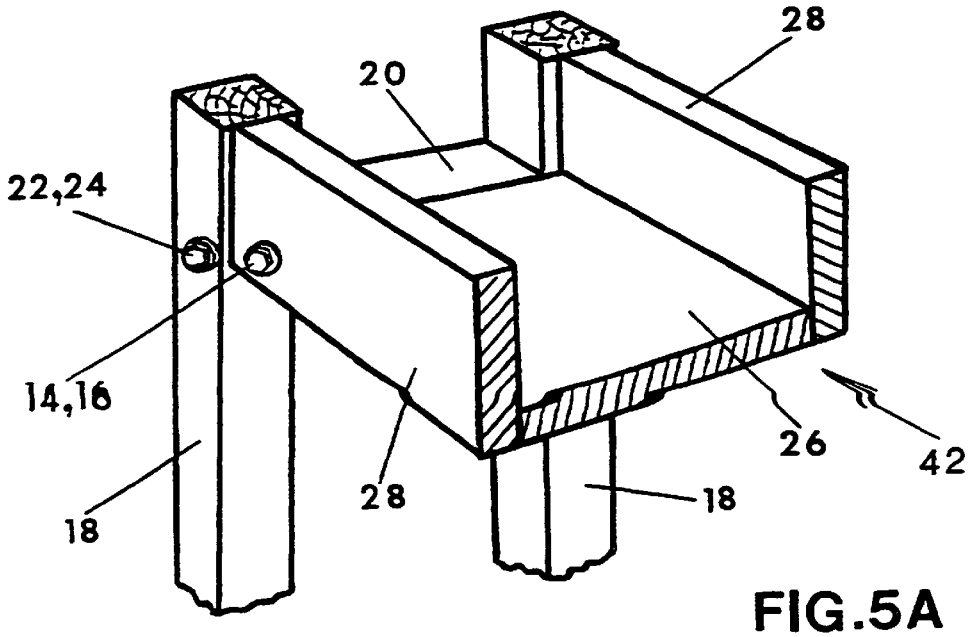
FIG. 5A is an enlarged perspective cross-sectional partial view of FIG. 1A taken along the plane 4A—4A of FIG. 1A.
Figure 3B:
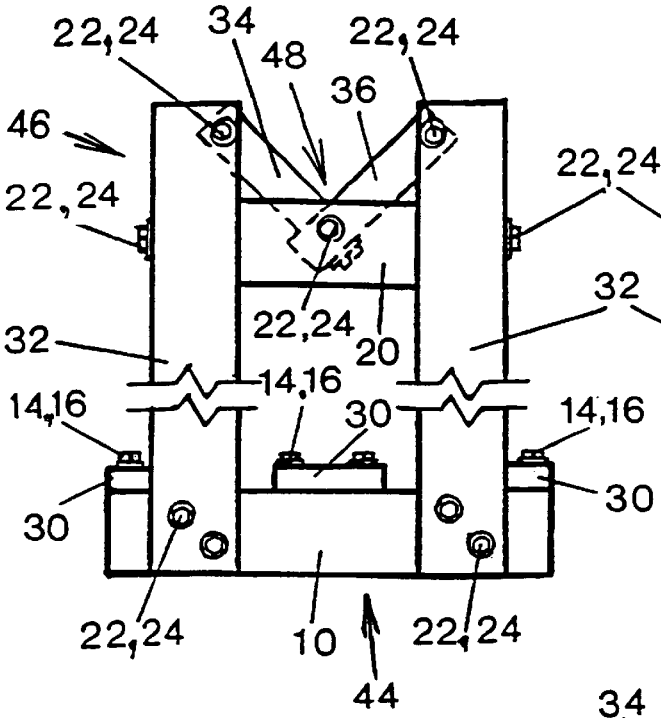
Figure 4B:
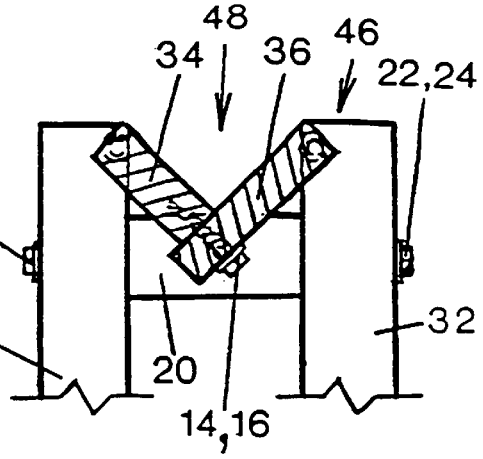
Figure 5B:
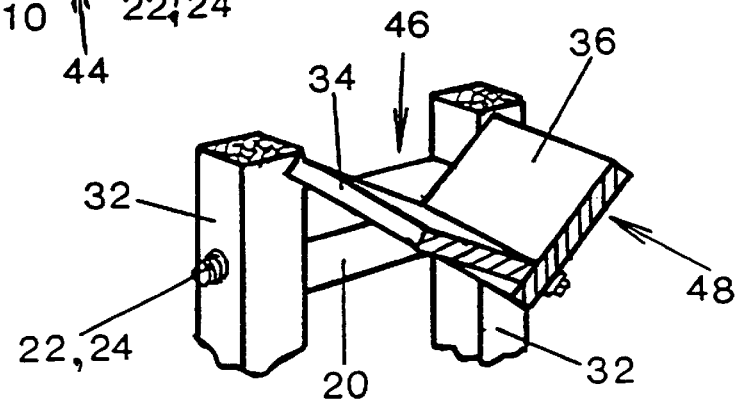
Figure 6B:
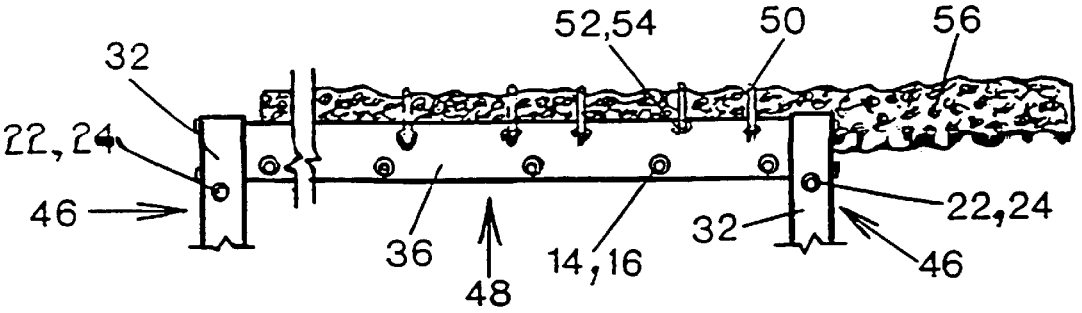

The features, objects and advantages of the second embodiment of my invention will be fully understood from the following description in connection with the accompanying illustrative drawings in which:

FIG. 1B is a perspective view of the firewood log storage rack,

FIG. 2B is a perspective exploded view of rack,

FIG. 3B is an enlarged rear elevation view of both external ends of rack,

FIG. 4B is an enlarged partial sectional view of FIG. 1B taken along the plane 4B—4B of FIG. 1B, FIG. 5B is an enlarged partial perspective view of FIG. 1B taken along the plane 4B—4B of FIG. 1B, FIG. 6B is a partial front elevation view of the kindling wood storage V-trough.

DETAILED DESCRIPTION OF THE INVENTION—FIG.'S 1A TO 5A; 1B TO 6B

Referring more particularly to the drawings of FIG.'S 1A through 5A of the first embodiment of my invention that relates to a firewood log storage rack configuration to accommodate a bulk volume of 64 cubic feet of logs commonly known as a ⅓ cord or face cord.

Another object of the first embodiment of my invention relates to a U-shaped cross-sectional configuration kindling wood storage trough shown in FIG. 1A taken along the plane 4A—4A of FIG. 1A and further detailed in FIG.'S 2A, 4A and 5A.

A second embodiment of my invention relates to an extended version of the first embodiment illustrated in FIG.'S 1B through 6B describing a firewood log storage rack Configuration commonly known as ¼ cord to accommodate a bulk volume of 36 cubic feet of logs.

A further object of the second embodiment of my invention relates to a V-shaped cross-sectional configuration kindling wood storage trough shown in FIG. 1B taken along the plane 4B—4B of FIG. 1B and further detailed in FIG.'S 4B and 5B.

An additional object of the second embodiment of my invention provides for restraining long tree saplings and long pieces of lumber within the restricted confines of said V-shaped cross-sectional trough configuration in preparation to be sawed into predetermined log lengths.

The construction of the first and second embodiments of my invention will be understood by a series of steps to be explained hereinafter.

The first embodiment of my invention illustrated in FIG.'S 1A through 5A comprises four sub-assemblies defined as follows: one base support sub-assembly 38, two upright end support sub-assemblies 40 located in opposed relationship attached to the opposite ends of the base support sub-assembly 38 and a U-shaped cross-sectional configuration, kindling wood storage trough sub-assembly 42.

The base support sub-assembly 38 is comprised of four base supports 10 of equal length equally spaced in a parallel manner shown in FIG.'S 1A and 2A.

Three stringers 12 of equal length are positioned atop the said base supports 10 and are equally spaced in a 90 degree orientation to the top surfaces of said base supports 10 and are securely mounted together with a plurality of screws 14 and washers 16.

Upright end support sub-assembly 40 is comprised of two vertical posts 18 positioned parallel to each other with a spacer block 20 contiguous with the inside surfaces of the two posts 18 and mounted securely together with a plurality of screws 22 and washers 24 shown in FIG.'S 1A through 5A.

The said upright end support sub-assemblies 40 are positioned with the open ends of the said sub-assemblies 40 resting on a solid base and the inside surfaces of said sub-assemblies 40 contiguous with the opposite external base support ends of the base support sub-assembly 38 which is also resting on the same solid base.

The open ends of the upright end support sub-assemblies 40 are mounted securely to the external ends of the base support sub-assembly 38 with a plurality of screws 22 and washers 24 shown in FIG.'S 1A through 3A.

The U-shaped cross-sectional configuration of the kindling wood trough sub-assembly 42 of the first embodiment of my invention is comprised of two similar parallel sides 28 placed in an upright position on edge with the lower inside flat longitudinal surface area of said sides 28 contiguous with the opposite edges of the base plank 26 in a U-shaped cross-sectional configuration and securely mounted together with a plurality of screws 14 and washers 16 shown in FIG.'S 1A through 5A.

The final assembly of the first embodiment of my invention is accomplished with the positioning of said kindling wood sub-assembly 42 in a horizontal longitudinal manner with the opposite open ends of said trough sub-assembly 42 placed between the inside surfaces of the two opposite upright end support sub-assemblies 40 with the top surface of the base plank 26 oriented at same level as the top surface of the spacer block 20 of each upright end support sub-assemblies 40 and simultaneously positioning the said trough sub-assembly 42 centrally between the inside surfaces of the said upright end support sub-assemblies 40 at both ends of the base support sub-assembly 38 and mounted securely together with a plurality of screws 22 and washers 24.

The second embodiment of my invention comprises four sub-assemblies defined as follows: one base support sub-assembly 44, two upright end support sub-assemblies 46 located in opposed relationship attached to the opposite ends of the base support sub-assembly 44 and a V-shaped cross-section configuration of the kindling wood storage trough sub-assembly 48 shown in FIG.'S 1B to 6B.

The base support sub-assembly 44 is comprised of four base supports 10 of equal length equally spaced in a parallel manner shown in FIG.'S 1B through 3B.

Three stringers 30 of equal length are positioned atop the base supports 10 and are equally spaced in a 90 degree orientation to the top surfaces of the base supports 10 and are securely mounted together with a plurality of screws 14 and washers 16.

Upright end support sub-assembly 46 is comprised of two vertical posts 32 positioned parallel to each other with a spacer block 20 contiguous with the inside surfaces of the two posts 32 and mounted together with a plurality of screws 22 and washers 24 shown in FIG.'S 1B through 6B.

The said upright end support sub-assemblies 46 are positioned in an upright vertical position with the open ends of the posts 32 resting on a solid base and the inner surfaces of the said sub-assemblies 46 contiguous with the outer external base support ends of the base support sub-assembly 44 which is also resting on the same solid base.

The open ends of the upright end support sub-assemblies 46 are mounted securely to the outer external ends of the base support sub-assembly 44 with a plurality of screws 22 and washers 24 shown in FIG.'S 1B through 3B.

The V-shaped cross-sectional configuration of the kindling wood trough sub-assembly 48 of the second embodiment of my invention is comprised of a side 34, one edge of which is seated flush against the bottom portion of the inside longitudinal flat area of side 36 in a 90 degree orientation and mounted securely with a plurality of screws 14 and washers 16 to form a V-shaped trough sub-assembly 48 shown in FIG.'S 1B through 6B.

The final assembly of the second embodiment of my invention is accomplished with the positioning of said trough sub-assembly 48 in a horizontal longitudinal manner with the opposite open ends of said trough sub-assembly 48 placed between the inside surfaces of the two opposite upright end support sub-assemblies 46 and said V-shaped trough aligned in a manner with the inner apex of said V-shaped trough at the same level and centered with the top horizontal surface of spacer blocks 20 located at opposite ends of rack while the side 34 and side 36 are oriented about the apex in a 45 degree angle to the vertical and apex of said V-shaped trough centrally located between the two vertical posts 32 of each opposite ends of the rack shown in FIG.'S 1B to 6B and mounted securely with a plurality of screws 22 and washers 24.

An additional object of the second embodiment of my invention provides said V-trough restraining long tree saplings 56 and long pieces of lumber, not shown, within the confined V-shaped configuration of said trough sub-assembly 48 with a plurality of bungee cords 50 stretched taut over the exposed top portion of the said long tree saplings 54 and long pieces of lumber by a plurality of hooks 52, attached to both ends of said bungee cords 50 and said hooks 52 securely locked to an equal number of eye hooks 54 equally spaced and attached to the outside upper sides of said trough sub-assembly 48.

The sawing operation of said saplings 56 into firewood logs is accomplished by releasing the taut bungee cords 50 and extending said saplings 56 and said lumber, not shown, in a lateral direction extended beyond the rack in a cantilevered position sufficiently forward to provide adequate exposed said saplings 56 and said lumber to be cut into a plurality of predetermined log lengths, not shown.

While I have shown and described the two embodiments of my invention, it will be understood that they may be embodied otherwise than as herein specifically illustrated or described and that in the illustrated embodiments certain changes in details of construction such as element materials, hardware, fastening and joining options and in the arrangement of parts may be made without departing from the underlying idea or principle of the invention within the scope of the appended claims.

What I claim as my invention is:

1. A rack to store firewood logs, lumber and kindling in an enclosed dedicated opening that encompasses an accurately defined bulk quantity measure of said firewood in a ⅓ cord, also known as face cord or rick generally accepted as a standard volume capacity of 4 feet high by 8 feet long and 2 feet deep and further embodying a raised U-trough configuration to provide storage for kindling wood sufficiently above ground to allow adequate air circulation to retard moisture, mildew, wet wood, wood rot and to hasten the drying out process of newly cut kindling.

2. A rack to store said firewood as claimed in claim 1 further comprising a configuration to store said firewood above ground sufficiently to provide adequate air circulation to retard moisture, mildew, wet wood, wood rot and to hasten the drying out process of newly cut firewood.

3. A rack to store firewood logs, kindling and lumber as claimed in claim 1 that further embodies multiple use capacity of the storage rack for unlimited diverse purposes, some of which are to store lawn garden equipment and tools, garbage cans, plant potting materials, potted plants, hardware and any items that can be contained within the confines of the rack opening and kindling wood troughs.

4. A rack to store firewood materials as claimed in claim 1 whose construction materials are not limited to a wood frame configuration, but can be constructed out of other suitable materials and optional fastening and joining methods that will satisfy the basic design configuration and remain faithful to the integrity of the original invention concept, with alternate construction materials from a group of metal alloys, steel, aluminum and plastic in tubular or varying predetermined cross-sectional shapes.

5. A rack to store firewood materials as claimed in claim 1 otherwise than as herein specifically illustrated or described and that in the illustrated embodiments certain changes in details of element materials, hardware, construction and in the arrangement of parts may be made without departing from the underlying idea or principle of my invention within the scope of the amended claims.

6. A rack to store firewood logs, kindling and lumber in an enclosed dedicated opening that encompasses an accurately defined bulk quantity measure of said firewood in a ¼ cord generally accepted as a standard volume capacity of 3 feet high by 6 feet long and 2 feet deep and further embodying a raised V-trough configuration to provide storage for kindling wood sufficiently above ground to allow adequate air circulation to retard moistur, mildew, wet wood, wood rot and to hasten the drying out process of newly cut kindling and further embodying multiple use of the V-trough configuration to safely contain and secure long tree saplings and long pieces of lumber that are held within the confines of the said V-trough by a plurality of bungee cords having cords having hooks at both ends, said hooks engaging receptacle hardware attached to the outside upper flat surfaces of the V-trough and with the stretched bungee cords restraining the said saplings or lumber preparatory to being sawed into log lengths, the tree saplings or lumber then can be extended laterally beyond the rack in a cantilevered position to be sawed into predetermined log lengths.

7. A rack to store said firewood as claimed in claim 6 further comprising a configuration to store said firewood above ground sufficiently to provide adequate air circulation to retard moisture, mildew, wet wood, wood rot and to hasten the drying out process of new cut firewood.

8. A rack to store firewood logs, kindling and lumber as claimed in claim 6 that further embodies multiple use capacity of the storage rack for unlimited diverse purposes, some of which are to store lawn garden equipment and tools, garbage cans, plant potting materials, potted plants, hardware and any items that can be contained within the confines of the rack opening and kindling wood troughs.

9. A rack to store firewood materials as claimed in claim 6 whose construction materials are not limited to a wood frame configuration, but can be constructed out of other suitable materials and optional fastening and joining methods that will satisfy the basic design configuration and remain faithful to the integrity of the original invention concept, with alternate construction materials from a group of metal alloys, steel, aluminum and plastic in tubular or varying predetermined cross-sectional shapes.

10. A rack to store firewood materials as claimed in claim 6 otherwise than as herein specifically illustrated or described and that in the illustrated embodiments certain changes in details of element materials, hardware, fastening and joining methods, construction and in the arrangement of parts may be made without departing from the underlying idea or principle of my invention within the scope of the amended claims.

* * * * *